US005446338A

United States Patent [19]

Lee

[11] Patent Number: 5,446,338

[45] Date of Patent: Aug. 29, 1995

[54] CATHODE RAY TUBE PROVIDED WITH A BAR CODE

[75] Inventor: Sun-hyeong Lee, Pusan, Rep. of Korea

[73] Assignee: Samsung Electron Devices Co., Ltd., Kyungki-do, Rep. of Korea

[21] Appl. No.: 996,919

[22] Filed: Dec. 29, 1992

Related U.S. Application Data

[63] Continuation-in-part of Ser. No. 738,617, Jul. 31, 1991, abandoned.

[30] Foreign Application Priority Data

Aug. 8, 1990 [KR] Rep. of Korea ..... 90-12013
Jun. 10, 1992 [KR] Rep. of Korea ..... 92-10060

[51] Int. Cl.[6] ..... H01J 31/00

[52] U.S. Cl. ..... 313/478; 313/477 R; 220/2.1 A; 428/428

[58] Field of Search ..... 313/478, 477 HC, 477 R; 220/2.1 A; 101/150; 428/426, 195, 428, 446; 264/22, 25, 119, 322; 219/121.69

[56] References Cited

U.S. PATENT DOCUMENTS

| | | | |
|---|---|---|---|
| 4,327,283 | 4/1982 | Heyman et al. | 235/487 |
| 4,377,890 | 3/1983 | Miller | 313/477 R X |
| 4,515,867 | 5/1985 | Bleacher et al. | 428/428 X |
| 4,600,630 | 7/1986 | Quinn et al. | 428/426 X |
| 4,791,267 | 12/1988 | Yokoyama et al. | 219/121.69 |

*Primary Examiner*—Sandra L. O'Shea
*Assistant Examiner*—Ashok Patel
*Attorney, Agent, or Firm*—Leydig, Voit & Mayer

[57] ABSTRACT

A cathode ray tube includes a panel having an inner surface and an outer surface and a funnel connected to the panel having a neck portion dimensioned to house an electron gun. A single strip of synthetic resin material is coated on a predetermined area of the panel. The synthetic resin includes intaglio in the form of a bar code. The heat-resistant synthetic resin material consists of silicone rubber or consists essentially of a silicone-modified vinyl resin and aluminum. The bar code is undamaged by heat, even during a heating process of several steps, e.g., a baking process, so that the bar code and sheet can be formed during the initial steps of manufacturing the cathode ray tube. Accordingly, since the bar code is present throughout the CRT's manufacture, product management can be done all along the assembly line.

14 Claims, 1 Drawing Sheet

CATHODE RAY TUBE PROVIDED WITH A BAR CODE

This application is a continuation-in-part of application Ser. No. 07/738,617, filed on Jul. 31, 1991 (now abandoned).

BACKGROUND OF THE INVENTION

The present invention relates to a cathode ray tube provided with a bar code, and more particularly to a cathode ray tube having an improved bar code.

A bar code provides product identification information in order to computerize the management of processes during manufacturing, after delivery, etc., and is also provided and used in a cathode ray tube.

In a conventional cathode ray tube, as shown in FIG. 1, a sheet 40 on which a bar code is marked is most generally attached to a skirt 50 of cathode ray tube 10. The sheet 40 is generally formed of a heat resisting paint, on which is provided a bar code of a sharply contrasting color.

This conventional bar code providing method is overly difficult to implement because a liquid paint is coated and then dried on the skirt, into which the bar code itself is carved by a different paint in liquid form and dried. Moreover, the addition of this second paint material used for providing the bar code is burdensome and time-consuming.

U.S. Pat. No. 4,327,283 describes a glass workpiece with a bar code which consists of a thin, dark-colored undercoating and a thin, light-colored overcoating. The bar code marking may be made by depositing the coatings, each of which consists essentially of pigment particles and an alkali silicate binder, and then recessing the marking into and through the overcoating. The recessing may be achieved by ablating the overcoating with a laser beam. In U.S. Pat. No. 4,515,867, the undercoating contains an operative proportion of mica particles, and the overcoating is essentially free from mica, so as to increase resistance of the undercoating laser ablation.

Such improved coatings can be produced rapidly on an automatic machine which will also ablate the marking into the workpiece. However, the troublesome problems inherent to double-coating still remain.

It is, therefore, desirable to provide a bar code marking of a single coating layer having the properties required for a bar code of cathode ray tubes, for example, resistance to heat and chemicals, readability and adhesiveness to glass material.

SUMMARY OF THE INVENTION

It is an object of the present invention to provide a cathode ray tube with a bar code whose structure is improved, to obviate the above-mentioned problems.

Especially, the present invention includes a cathode ray tube with a bar code marking which is carved on a single coating layer, and which has resistance to heat and chemicals, readability, and a good adhesiveness to glass material.

To achieve the above object, the present invention provides a cathode ray tube comprising a panel having an inner surface including a screen, a funnel having a neck dimensioned to house an electron gun, a skirt disposed between the panel and the funnel and a bar code marking coated on a predetermined area of the panel, the bar code marking being carved on a single layer of a sheet consisting essentially of a heat-resistant synthetic resin material.

While in the prior art a plurality of coatings are required for bar code marking, according to the present invention, a single coating is sufficient to form a heat-resistant sheet into which the bar code is carved. After the sheet is coated and dried, the bar code is carved by thermal energy, for example, laser processing. The heat-resistant synthetic resin material used in the present invention is preferably silicone rubber or silicone-modified vinyl resin.

Such a single coating simplifies the procedure of the present invention, thus saving time and money. Further, the synthetic resins used in the present invention are highly resistive to heat and chemicals and exhibit good adhesiveness to glass material and good readability.

BRIEF DESCRIPTION OF THE DRAWINGS

The above objects and other advantages of the present invention will become more apparent by describing in detail a preferred embodiment thereof with reference to the attached drawings in which.

DETAILED DESCRIPTION OF THE INVENTION

Figure 1:
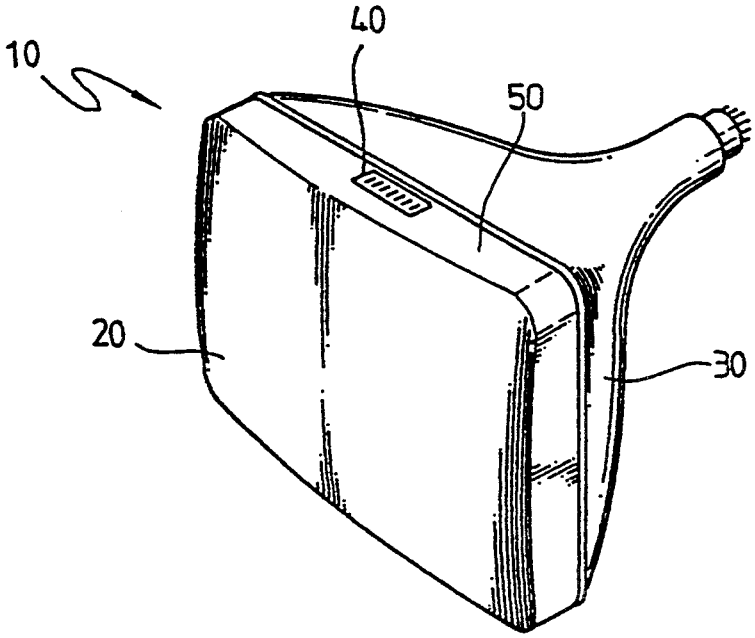
FIG.1 (PRIOR ART)
FIG. 1 is a perspective view of a cathode ray tube provided with a conventional bar code.
Figure 2:
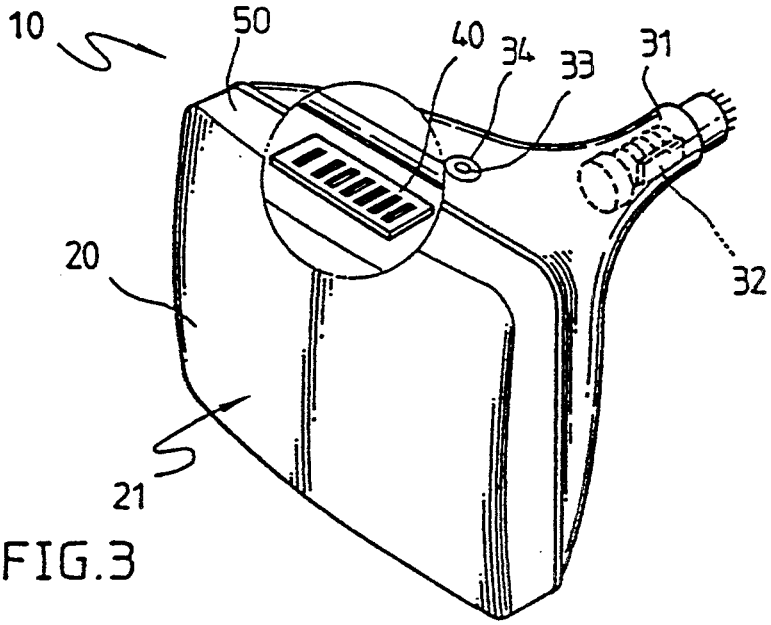
FIG. 2 is a perspective view of a cathode ray tube provided with a bar code according to the present invention.
Figure 3:
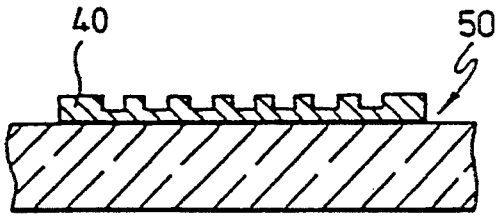
FIG. 3 is a cross-sectional view of a sheet on which is written a bar code provided on a skirt of a cathode ray tube according to the present invention as shown in FIG. 2.

In FIG. 2, a cathode ray tube provided with a bar code according to the present invention is schematically shown.

Like any typical cathode ray tube, the cathode ray tube of the present invention comprises a panel 20 on whose inner surface a screen 21 is formed, and a neck 31 of a funnel 30, into which an electron gun 32 is installed. An anode terminal 33 supplying a very high voltage to electron gun 32 and screen 21 is provided on the outer surface of funnel 30, and an insulating film 34 is formed around the anode terminal to prevent current leakage. A skirt is positioned between the panel 20 and the funnel 30.

A sheet 40 of a synthetic resin material is coated on a predetermined area of side panel 20 of cathode ray tube 10, and a bar code is striped and formed in bars on sheet 40. The bar code is formed by intaglioing into the sheet 40 and is partially formed by thermal energy, laser processing, etc.

The sheet 40 of a synthetic resin material may preferably be made of a silicone rubber-like insulating film 34. Insulating film 34 is formed by being coated around anode terminal 33 of cathode ray tube 10. Accordingly, sheet 40 is formed during the same process as insulating film 34. After the sheet and the film dry and harden, and before proceeding to the subsequent process, individual serial information, e.g. manufacturing data, stock number, etc., is written as an intaglio bar code on sheet 40 by a conventional laser processing machine.

The synthetic resin material of sheet 40 may also preferably consist essentially of a silicone-modified vinyl resin and aluminum. Silicone-modified vinyl resin is prepared from condensation of vinyl resin and silicone in the presence of an acid catalyst. Such a silicone-modified vinyl resin is highly resistive to heat and chemicals, while exhibiting good adhesiveness to glass material, and especially, when mixed with aluminum in a specified ratio, it has properties suitable to bar code marking of a cathode ray tube. Here, the aluminum may be replaced with aluminum oxide.

The synthetic resin material consisting essentially of the silicone-modified vinyl resin and aluminum may be prepared as follows:

A mixture of 5 to 50 parts of vinyl resin, 30 to 100 parts of silicone and 0.01 to 1.0 parts of acid catalyst in a proper solvent is heated at a temperature ranging from 30° to 70° C., to obtain a silicone-modified vinyl resin solution. The concentration of the silicone-modified vinyl resin in the solution is adjusted to be in the range of 20 to 50% by changing the amount of the added solvent. Then, 20 to 90 parts of the silicone-modified vinyl resin solution is mixed with 5 to 60 parts of aluminum and a conventional dispersant in a proper solvent, to obtain a coating composition for bar code marking. In this coating composition, the silicone-modified vinyl resin and the aluminum should be mixed so that their weight ratio is in the range of 1:2 to 2:1.

The vinyl resin used in the present invention should include resins in the hydroxyl group which are soluble in alcohols. Such a vinyl resin includes, for example, B-20H, B-30H, B-30T, B-60H, and B-60T manufactured by Hoechst, and S-Lec BL-1,2,3, BM-1,2,5 manufactured by Sekisui Plastic. The silicone used in this invention should be a silicate which can be hydrolyzed. Examples of such a silicone include ES-40 manufactured by Union Carbide, Dynasil 40 by Dynamit Nobel, Silbond 40 by AKZO, and TES 28, TES 40, VP 2253 and VP 2255 manufactured by Wacker. An acid catalyst is added to catalyze the reaction between the silicate and the vinyl resin. Such an acid may be an organic acid or inorganic acid. The solvent may be an alcohol, such as methanol, ethanol, isopropanol, n-butanol or isobutanol, or an ether, such as ethyleneglycol monoethyl ether, ethyleneglycol monobutyl ether or propyleneglycol methyl ether.

The thus-prepared coating composition is then coated on a predetermined area of the skirt of the cathode ray tube and dried to form a sheet of a synthetic resin material for bar code marking. The sheet consists essentially of the silicone-modified vinyl resin and the aluminum, whose weight ratio ranges from 1:2 to 2:1. If their weight ratio is out of this range, the resistance to heat and chemicals, hardness, adhesiveness and readability suffer such that the sheet would be unsuitable for a bar code marking.

After the above sheet of silicone-modified vinyl resin and aluminum is formed, a bar code marking is carved on the sheet in intaglio by a conventional laser processing machine, for example.

The present invention will be described in detail below.

<Example 1>

A mixture of 50 parts of vinyl resin, 100 parts of silicone and 1.0 parts of acid catalyst in butylcellosolve (ethyleneglycol monobutyl ether) was heated at a temperature of about 50° to 60° C., to obtain a silicone-modified vinyl resin solution. The concentration of the silicone-modified vinyl resin in the solution was adjusted to be 25%. Then, 75 parts of the silicone-modified vinyl resin solution was mixed with 15 parts of aluminum, 2 parts of a conventional dispersant and 20 parts of butylcellosolve to obtain a coating composition for bar code marking. In this coating composition, the weight ratio of the silicone-modified vinyl resin to the aluminum is 1.25:1. The above-prepared coating composition was then coated to about a 30–40 um thickness on a predetermined area of the skirt of the cathode ray tube and dried at about 100° C. for 1 hour to form a sheet for bar code marking.

<Example 2>

As described in Example 1, the silicone-modified vinyl resin was prepared to be 25% in the solution. Then, 65 parts of the silicone-modified vinyl resin solution was mixed with 20 parts of aluminum, 2 parts of a conventional dispersant and 20 parts of butylcellosolve to obtain a coating composition for bar code marking. In this coating composition, the weight ratio of the silicone-modified vinyl resin to the aluminum is 1:1.23. The above-prepared coating composition was then spray-coated to about a 20–30 um thickness on a predetermined area of the skirt of the cathode ray tube and dried at about 300° C. for 2 hours to form a sheet for bar code marking.

<Example 3>

The coating composition prepared as Example 2 was spray-coated to about a 10–15 um thickness on a predetermined area of the skirt of the cathode ray tube and dried at about 450° C. for 2 hours to form a sheet for bar code marking.

<Example 4>

A mixture of 5 parts of vinyl resin, 30 parts of silicone and 0.5 parts of acid catalyst in butylcellosolve was heated at a temperature of about 40° to 50° C., to obtain a silicone-modified vinyl resin solution. The concentration of the silicone-modified vinyl resin in the solution was adjusted to be 30%. Then, 65 parts of the silicone-modified vinyl resin solution was mixed with 22 parts of aluminum, 3 parts of a conventional dispersant and 17 parts of butylcellosolve to obtain a coating composition for bar code marking. In this coating composition, the weight ratio of the silicone-modified vinyl resin to the aluminum is 1:1.13. The above-prepared coating composition was then coated to about a 20–30 um thickness on a predetermined area of side panel of the cathode ray tube and dried at about 450° C. for 2 hours to form a sheet for bar code marking.

<Example 5>

As described in Example 4, the silicone-modified vinyl resin was prepared to be 30% in the solution. Then, 65 parts of the silicone-modified vinyl resin solution was mixed with 20 parts of aluminum, 2 parts of a conventional dispersant and 20 parts of butylcellosolve to obtain a coating composition for bar code marking. In this coating composition, the weight ratio of the silicone-modified vinyl resin to the aluminum is 1:1.03. The above-prepared coating compsition was then spray-coated to about a 10–15 um thickness on a predetermined area of the skirt of the cathode ray tube and dried at about 450° C. for 2 hours to form a sheet for bar code marking.

<Comparative example 1>

A mixture of 50 parts of vinyl resin, 100 parts of silicone and 1.0 parts of acid catalyst in butylcellosolve (ethyleneglycol monobutyl ether) was heated at a temperature of about 50° to 60° C., to obtain a silicone-modified vinyl resin solution. The concentration of the silicone-modified vinyl resin in the solution was adjusted to be 10%. Then, 65 parts of the silicone-modified vinyl resin solution was mixed with 20 parts of aluminum, 3 parts of a conventional dispersant and 20 parts of butylcellosolve to obtain a coating composition for bar code marking. In this coating composition, the weight ratio of the silicone-modified vinyl resin to the aluminum is 1:3.1. The above-prepared coating composition was then coated to about a 20–30 um thickness on a predetermined area of the skirt of the cathode ray tube and dried at about 450° C. for 2 hours to form a sheet for bar code marking.

<Comparative example 2>

As described in Example 4, the silicone-modified vinyl resin was prepared to be 30% in the solution. Then, 15 parts of the silicone-modified vinyl resin solution was mixed with 30 parts of aluminum, 4 parts of a conventional dispersant and 30 parts of butylcellosolve to obtain a coating composition for bar code marking. In this coating composition, the weight ratio of the silicone-modified vinyl resin to the aluminum is 1:6.7. The above-prepared coating composition was then spray-coated to about a 20–30 um thickness on a predetermined area of the skirt of the cathode ray tube and dried at about 450° C. for 2 hours to form a sheet for bar code marking.

Readability, resistance to heat and acid, hardness and adhesiveness of the resultant sheets are determined and shown in Table 1.

TABLE 1

| Examples | Readability | Resistance to heat | Resistance to acid | Hardness | Adhesiveness |
|---|---|---|---|---|---|
| Example 1 | Δ | ○ | Δ | H | ○ |
| Example 2 | ○ | ○ | ○ | H | ○ |
| Example 3 | ⊙ | ○ | ○ | 2H | ○ |
| Example 4 | ⊙ | ⊙ | ○ | 2H | ○ |
| Example 5 | ⊙ | ⊙ | ○ | 2H | ○ |
| Comparative example 1 | ○ | | Δ | 3B | x |
| Comparative example 2 | ○ | Δ | Δ | 2B | x |

⊙: excellent
○: good
Δ: normal
x: poor

Readability was determined by Model SS45SR of Scan Star Co. Resistance to heat was estimated as the degree of discoloration after being stored at a temperature of 450° to 500° C. for 12 hours. Resistance to acid was estimated after being stored in 5% $H_2SO_4$ for 120 hours. Hardness and adhesiveness were determined and estimated according to the methods of JIS-K5400(6.14) and JIS-K5400(6.15), respectively.

As shown in Table 1, the sheets manufactured according to the present invention have the advantages of a good readability, resistance of heat and acid, hardness and adhesiveness. Therefore, the bar code marking carved on the sheet has the same advantages.

The bar code marking of the present invention is intaglio on the surface of the sheet 40, having a rough feel. This sheet has an advantage in the maintenance of bar code, compared with the conventional bar code sheet, namely, the sheet is undamaged by heat even during a heating process of several steps, e.g., a baking process. Accordingly, the bar code and sheet can be formed during the initial steps of manufacturing a cathode ray tube. Since the bar code is present from the beginning of the manufacturing process for the cathode ray tube, individual product management can be done all along the assembly line.

The present invention satisfies current product management methods which computerize production, quality control and other aspects of the product's management. Also, the loss of sheets provided with a bar code due to heat, humidity, etc., is reduced.

While the present invention has been particularly shown and described with reference to particular embodiments thereof, it will be understood by those skilled in the art that various changes in form and details may be effected therein without departing from the spirit and scope of the invention as defined by the appended claims.

What is claimed is:

1. A cathode ray tube comprising:

a panel having an inner surface and an outer surface;

a funnel connected to said panel having a neck portion dimensioned to house an electron gun;

a skirt positioned between said panel and said funnel; and a bar code marking coated on the skirt, said bar code marking consisting essentially of a sheet of heat resisting synthetic resin material disposed in a single layer.

2. A cathode ray tube as claimed in claim 1 wherein the material of said sheet consists of a silicone rubber.

3. A cathode ray tube as claimed in claim 1 wherein the bar code is an intaglio.

4. A cathode ray tube as claimed in claim 1 wherein the material of said sheet consists essentially of a silicone-modified vinyl resin and aluminum combination having a weight ratio ranging from 1:2 to 2:1.

5. A cathode ray tube as claimed in claim 1 wherein the material of said sheet consists essentially of a silicone-modified vinyl resin and aluminum oxide combination having a weight ratio ranging from 1:2 to 2:1.

6. A cathode ray tube comprising:

a panel having an inner surface and an outer surface;

a funnel connected to said panel having a neck portion dimensioned to house an electron gun;

a skirt positioned between said panel and said funnel; and a marking element adhered to said skirt, said marking element consisting of a single layer of alcohol soluble synthetic resin material.

7. A cathode ray tube as claimed in claim 6 wherein the synthetic resin material comprises silicone-modified vinyl resin.

8. A cathode ray tube as claimed in claim 6 wherein the marking element comprises intaglio.

9. A cathode ray tube comprising:

a panel;

a funnel having a neck for housing an electron gun;

a skirt positioned between said panel and said funnel; and a bar marking coating on said skirt, said bar code marking consisting of a sheet of heat resistant synthetic resin material formed in a single layer.

10. A cathode ray tube as claimed in claim 9 wherein the material of the sheet is selected from the group consisting of silicone rubber, silicone-modified vinyl resin, and a combination of silicone-modified vinyl resin, aluminum and aluminum oxide.

11. A cathode ray tube as claimed in claim 9 wherein the bar code is formed in intaglio.

12. A cathode ray tube as claimed in claim 10 wherein the material of the sheet includes a combination of silicone-modified vinyl resin and aluminum having a weight ratio ranging from 1:2 to 2:1.

13. A cathode ray tube as claimed in claim 10 wherein the material of the sheet includes a combination of silicone-modified vinyl resin and aluminum oxide having a weight ratio ranging from 1:2 to 2:1.

14. A cathode ray tube as claimed in claim 10 wherein the material of the sheet is soluble in alcohol.

* * * * *